US007287359B1

(12) United States Patent
Haschke et al.

(10) Patent No.: US 7,287,359 B1
(45) Date of Patent: Oct. 30, 2007

(54) TAG LIFTER PLATE

(75) Inventors: Eggo Haschke, Deerfield, IL (US); Robert Vedder, Round Lake Beach, IL (US)

(73) Assignee: Poly-Clip System Corp., Mundelein, IL (US)

( * ) Notice: Subject to any disclaimer, the term of this patent is extended or adjusted under 35 U.S.C. 154(b) by 23 days.

(21) Appl. No.: 11/420,028

(22) Filed: Jun. 8, 2006

(51) Int. Cl.
*B65B 51/05* (2006.01)
*B65B 61/20* (2006.01)

(52) U.S. Cl. ..... 53/135.1; 53/138.4

(58) Field of Classification Search ..... 53/135.1, 53/138.4

See application file for complete search history.

(56) References Cited

U.S. PATENT DOCUMENTS 1,869,116 A * 7/1932 Rambold ..... 53/134.2
3,483,801 A * 12/1969 Kupcikevicius ..... 493/223
4,044,450 A * 8/1977 Raudys et al. ..... 29/509
4,107,903 A * 8/1978 Wickersheim ..... 53/138.4
4,660,351 A * 4/1987 Saitoh ..... 53/417
5,165,216 A * 11/1992 May et al. ..... 53/413
5,771,664 A * 6/1998 Recchia, Jr. ..... 53/417
6,401,306 B1 6/2002 Hanten et al.
6,845,596 B2 * 1/2005 May et al. ..... 53/138.4
6,883,297 B2 4/2005 Kirk et al.
6,895,726 B2 5/2005 Pinto et al.
6,976,346 B2 * 12/2005 May et al. ..... 53/134.1
7,063,610 B2 6/2006 Mysker

* cited by examiner

*Primary Examiner*—John Sipos
(74) *Attorney, Agent, or Firm*—Trexler, Bushnell, Giangiorgi, Blackstone & Marr, Ltd

(57) ABSTRACT

A clipper has a punch movable in a reciprocating path from a retracted position to an extended position, a clip rail for feeding a clip into the reciprocating path of the punch, a tag loading window oriented to hold a tag in the reciprocating path of the punch, a die adjacent to the extended position of the punch, a knife movable in a reciprocating path from a retracted position to an extended position, the knife having a top side and a bottom side, the reciprocating path of the knife being adjacent to the die, and a tag lifter plate mounted between the die and the reciprocating path of the knife, the tag lifter plate having a top side, the top side being between the top side of the knife and the bottom of the knife when the knife is in the extended position.

7 Claims, 5 Drawing Sheets

20
22
24
40
36
112
26
32
50
30
28
52
38
34

TAG LIFTER PLATE

BACKGROUND OF THE INVENTION

This invention is generally directed to a system for encasing materials in plastic bags. The invention is more particularly directed toward the attachment of tags to plastic bags by a clipper. The invention will be described as used in encasing food products, such as poultry or other materials, in plastic bags, but can be used with any products, food or otherwise, that are encased in an outer wrapping, such as a bag, a net, or a flat sheet, and to which a tag is applied by a clip.

In the current art, poultry is sold to consumers as whole dressed birds or as cut-up parts on a tray. The whole bird or the tray of parts is placed in a clear plastic bag, manually or by an automated bagger apparatus, the bag is gathered to form a neck, and a clip is applied to the neck. Various types of clippers are used, including closed-mouth clippers and open-mouth clippers, in both manual systems and automated systems. Clippers are also used to make sausages, in which a pasty product is extruded into a tubular casing or a flat sheet rolled into a tube. Voiders form a neck in the extruded product and a pair of clips is applied to the neck to separate one sausage from the next.

Sellers of food products, such as poultry or sausage, want to apply some type of information to the product. This information can be a description of the product, a weight, a price, a lot number, an expiration date, the identity of the manufacturer or seller, or any other information of use to the manufacturer, seller, or consumer. One way to provide this information to is attach a tag to the bag.

A clipper as known in the art has a channel for feeding clips on sticks or reels. A automated apparatus or an operator gathers the neck of a plastic bag and orients that neck over a die. The operator or an automated tag feeder inserts a tag through a tag-loading window over the die. A punch strikes a clip, forcing the clip over the protruding tag, over the neck of the plastic bag, and onto a die, which forces the two legs of the clip to bend inward to close over the tag and the neck of the bag, sealing the contents inside the bag, and also attaching the tag to the bag. A knife then actuates to trim the excess bag material, or "tail", on the side opposite the encased material. Sellers desire to have very little tail protruding from the clip. The excess tail clippings are waste and are disposed of by the operator of the clipper.

A tag is generally made of a flexible plastic material, heavy-stock paper, or laminated or coated paper. Sometimes a portion of a tag protrudes into the path of the knife and is severed by the knife as it cuts the tail off the bag. Accordingly, small pieces of tag material end up in and around the clipping area. Users find this debris unsightly. Extra labor must be extended to clean up this debris. Moreover, if the product is a food product, such as poultry, there are sanitary issues raised by having small bits of plastic or paper flying around the clipper.

Accordingly, there is a need for a clipper that will avoid the problems of the prior art. The present invention meets this need.

SUMMARY OF THE INVENTION

The clipper of the present invention, for attaching clips and tags to bags, nets, or other wrapping material, in one embodiment has a punch movable in a reciprocating path from a retracted position to an extended position, a clip rail for feeding a clip into the reciprocating path of the punch, a tag loading window oriented to hold a tag in the reciprocating path of the punch, a die adjacent to the extended position of the punch, a knife movable in a reciprocating path from a retracted position to an extended position, the knife having a top side and a bottom side, the reciprocating path of the knife being adjacent to the die, and a tag lifter plate mounted between the die and the reciprocating path of the knife, the tag lifter plate having a top side, the top side being between the top side of the knife and the bottom of the knife when the knife is in the extended position.

In a first embodiment, the clipper of the present invention is manual. In another embodiment, the clipper is automated. In yet other embodiments, the clipper is incorporated into automated systems for encasing material in bags, for enclosing material in netting, or stuffing material into tubular casing.

BRIEF DESCRIPTION OF THE SEVERAL VIEWS OF THE DRAWINGS

The organization and maimer of the structure and operation of the invention, together with further objects and advantages thereof, may best be understood by reference to the following description, taken in connection with the accompanying drawings.

DETAILED DESCRIPTION OF THE PREFERRED EMBODIMENT OF THE INVENTION

Figure 1A:
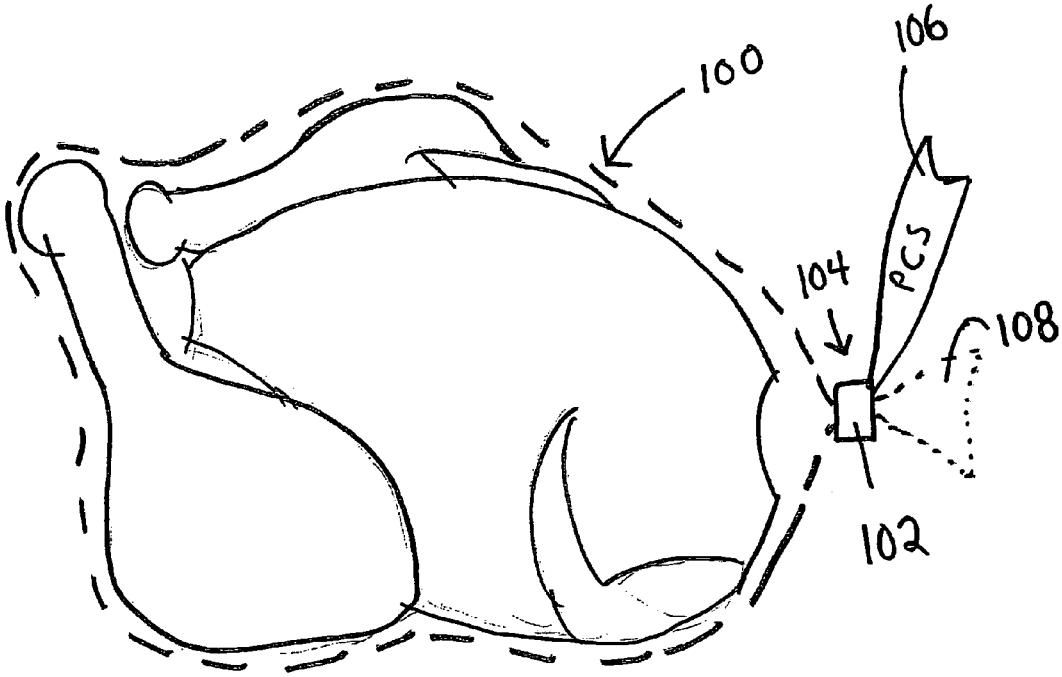
FIG. 1A is a view of a whole chicken encased in a clear plastic bag by the apparatus of the present invention.

While the invention may be susceptible to embodiments in different forms, there is shown in the drawings, and herein will be described in detail, a specific embodiment with the understanding that the present disclosure is to be considered an exemplification of the principles of the invention, and is not intended to limit the invention to that as illustrated and described herein. For example, the present disclosure describes the method and apparatus as used to encase poultry and poultry parts, but the same method and apparatus can be used for other poultry, for other food products, or for non-food material without departure from the invention. The present disclosure also describes the method and apparatus as used on plastic bags, but the same method and apparatus can be used on bags made of other material, on sheets used to encase material, such as sausages or whole-muscle products, or on netting used to encase material.

Accordingly, FIG. 1A shows a whole chicken encased in a bag 100, which is enclosed by a clip 102 applied to the neck 104 of the bag 100, attaching a tag 106 and leaving a tail 108 of the bag 100 extending from clip 102. Since bag 100 is generally made of clear plastic, it is shown in outline.

Figure 1B:
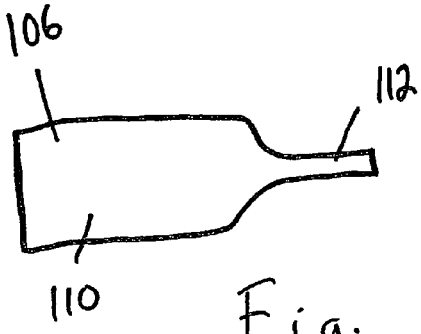
FIG. 1B is a plan view of a type of tag as used with the invention.
Figure 2:
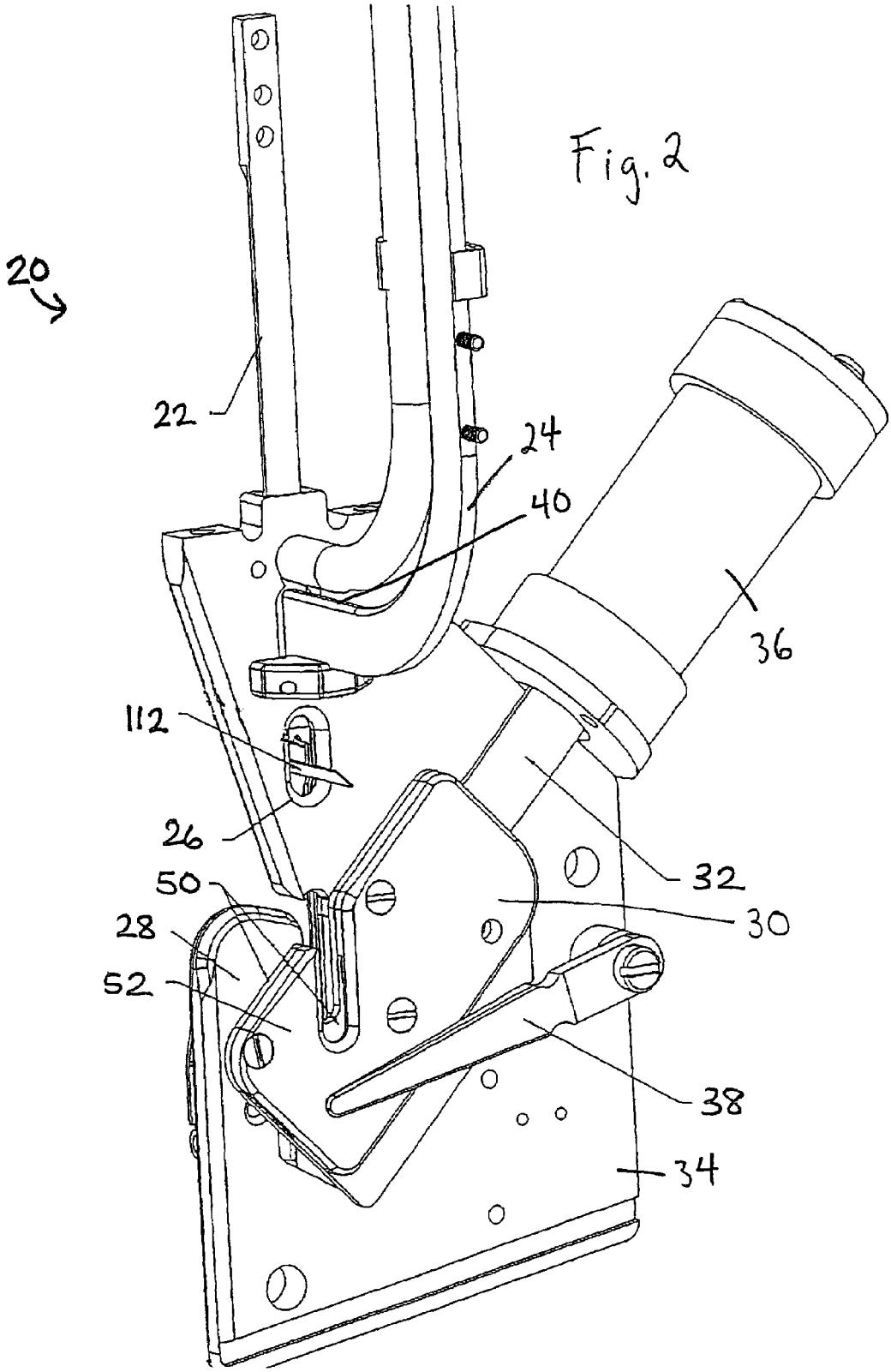
FIG. 2 is a front perspective view of the clipper of the preferred embodiment of the present invention, showing a tag attachment arm protruding through the tag loading window and the knife and punch retracted.
Figure 3:
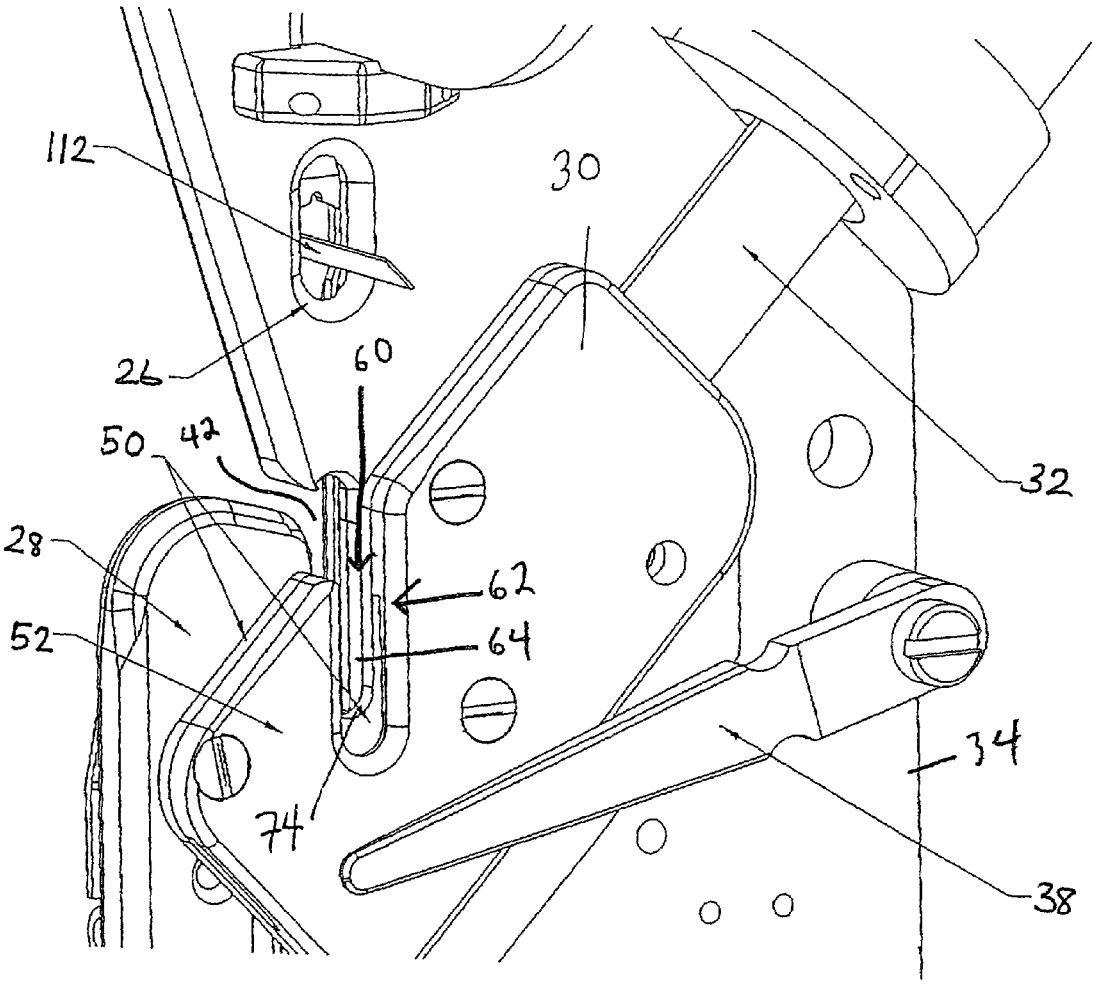
FIG. 3 is a close-up perspective view of the clipper of FIG. 1.

A representative tag 106 is shown in FIG. 1B. Tag 106 has a main body section 110 and an attachment arm 112.

The clipper 20 of the preferred embodiment of the present invention is shown in FIGS. 2 through 5. Clipper 20 has a punch 22, a clip rail 24, a tag-loading window 26, a die 28, a knife guide 30, and a knife 32, all mounted on a frame 34.

Punch 22 can be manually operated, such as by a lever, or powered, such as by a hydraulic, usually air-operated piston. Knife 30 can also be manually operated or can be powered. In the illustrated embodiment, knife 30 is actuated by air-operated cylinder 36. A compressor or plant air supply is used to power cylinder 36. As illustrated, a trigger 38 is used to control actuation of cylinder 36. Alternatively, a foot pedal, push button, or other triggering means can be used. In an automated system, cylinder 36 is controlled by the control logic of the automated apparatus.

Punch 22 moves in a reciprocating path from a retracted position, remote from die 28, to an extended position, adjacent die 28.

In the illustrated apparatus, clips 40 slide down clip rail 24 from a reel, not shown, in a conventional maimer. Clips 40 are preferably standard clips, having the shape of an inverted U, such as those described in U.S. Pat. No. 6,401,306, Sealing Clip for Bags and Tubes, and Matrix for Sealing the Latter, the disclosure of which is incorporated herein by reference. In other embodiments, clips 40 are inserted in magazines or in sticks. In the illustrated embodiment, as a chain of clips 40 slide down rail 24 in a conventional manner, the first clip 40*a* of clips 40*a*, 40*b*, 40*c*, etc., is placed under punch 22.

The attachment arm 112 of a tag 106 is inserted through tag loading window 26, placing tag 106 in the path of punch 22. Tag loading window 26 in the illustrated embodiment is an aperture in frame 34. Tag loading window can be an means to hold tag 106 in the path of punch 22, such as a channel, a clip, or rollers. In the illustrated embodiment, the operator inserts tag 106 mamially. In other embodiments, an automated tag feeder places tag 106 in tag loading window 26. Tag 106 can be part of an extended strip of tags manufactured in a strip and separated by perforations, then mounted on a reel or other feeder, or tag 106 can be one of individual pieces. Tag 106 can be a homogenous piece of plastic, paper, or metal, or can be paper, plastic, or metal attached to a loop made or wire or string, or can have another configuration known in the art.

Die 28 is preferably one as described in FIGS. 5A through 5C and 7A through 7C of the '306 patent. In the illustrated embodiment, an operator manually gathers a bag 100 to form a neck 102 and places the neck 102 within the jaw 42 of die 28. In other embodiments, automated voiding gates or automated gathering members form a neck 102 in the bag 100, or in, for example, a tube of extruded sausage meat, and place the neck 102 in the jaw 42. When the neck 102 of the bag 100 is in jaw 42, that neck 102 is over the die of die 28 and in the path of punch 22.

Knife guide 30 is mounted to die 28 and, in the illustrated embodiment, is a tag lifter plate 50 and a knife guide plate 52. Tag lifter plate 50 and knife guide plate 52 are generally parallel toe ach other and are mounted adjacent to die 28. Tag lifter plate 50 is proximal to die 28 and knife guide plate 52 is distal to die 28. Plates 50, 52 have generally rectangular shapes with a first notch 60 in tag lifter plate 50 and a second notch 62 in knife guide plate 52. Each notch 60, 62 is formed to generally align with each other and with jaw 42. Accordingly, when a neck 102 of a bag 100 is placed in jaw 42, that neck 102 necessarily protrudes through notch 60 and notch 62.

Notch 60, however, is slightly shallower than notch 62, as shown in FIGS. 2 through 5. In the preferred embodiment, the difference in depth of notch 60 and notch 62 is about five millimeters. Notches 60, 62 form aperture 64.

Knife 32 moves in a reciprocating path within a groove formed between plates 50, 52. Knife 32 moves from a retracted position, remote from aperture 64, to an extended position, in which at least knife edge 68 is through aperture 64. Knife 32 has a top side 70 and a bottom side 72, defining the width 74 of knife 32. The reciprocating path of knife 32 is adjacent die 28, so that tail 108 of bag 100 will cross that reciprocating path and knife edge 68 will sever tail 108.

In operation, an operator first places a tag in tag-loading window 26, so that attachment arm 112 protrudes into the path of punch 22. The operator then places a dressed bird such as a chicken or a turkey in a plastic bag 100, squeezes to remove excess air, and twists the top of bag 100 to form neck 102. The operator, facing clipper 20, then places the neck 102 in jaw 42 and aperture 64 of clipper 20, by grasping the encased poultry in a left hand and the top of the bag 100 with a right hand. As neck 102 of bag 100 moves into jaw 42 and aperture 64, the operator's right hand contacts trigger 38, which first causes punch 22 to actuate. Punch 22 actuates in a downward path, initially contacting clip 40*a* and forcing clip 40*a* downward. As clip 40*a* descends, it contacts attachment arm 112 and carries tag 106 along. When clip 40*a* nears the neck 102 of the bag 100, each leg of clip 40*a* descends on either side of neck 102, trapping tag 106 between clip 40*a* and neck 102 of bag 100. As punch 22 continues its downward stroke, the legs of clip 40*a* encounter die 28 and are squeezed together in a conventional maimer, sealing bag 100 and clipping tag 106 to bag 100.

Air cylinder 36 then actuates to commence the downward stroke of knife 30. As knife 30 moves from its retracted position to its extended position, knife edge 68 contacts bag 100 and severs tail 104.

Figure 4:
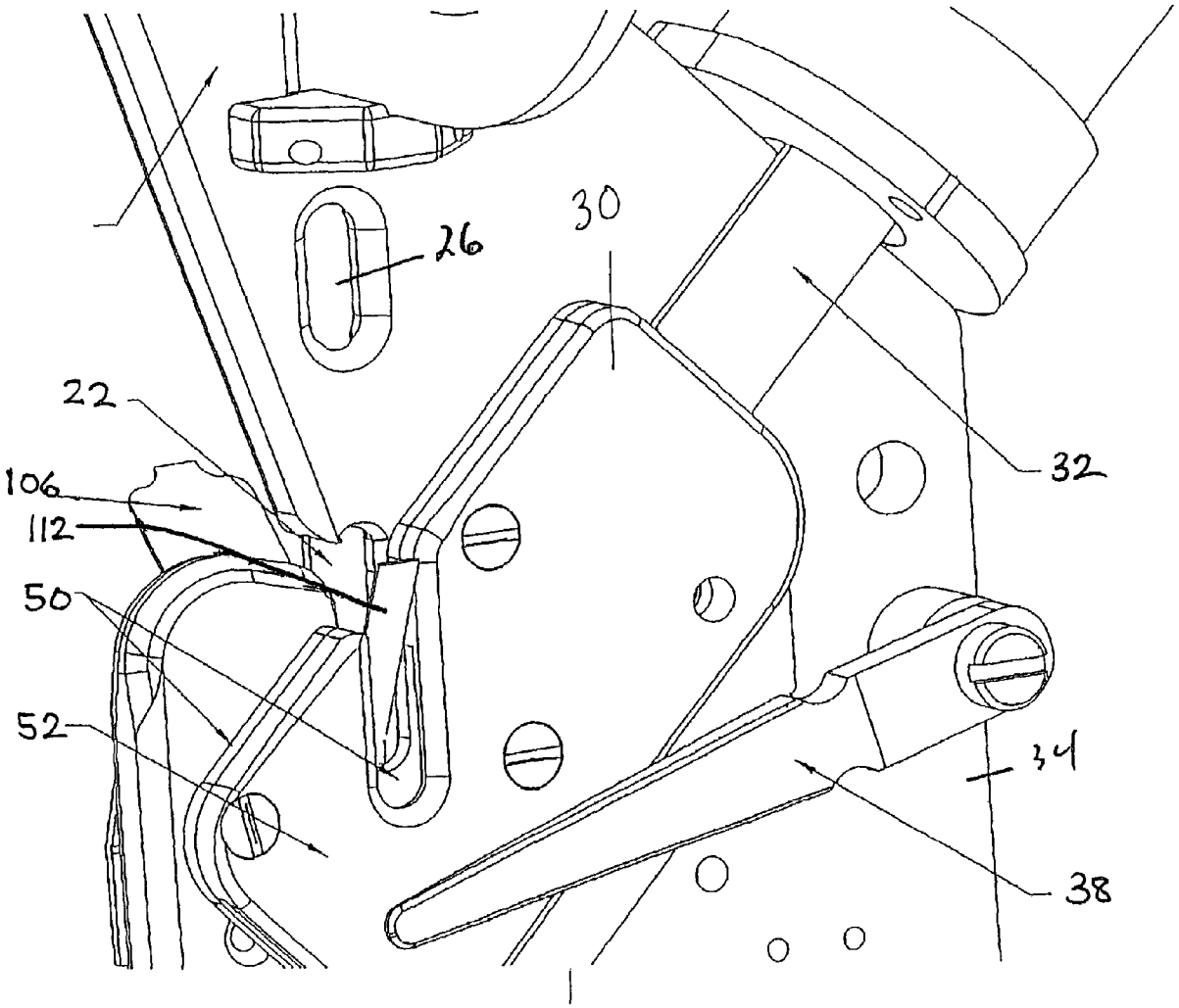
FIG. 4 is a close-up perspective view of the clipper of FIG. 1, showing a tag attachment arm in the knife guide and the knife retracted.
Figure 5:
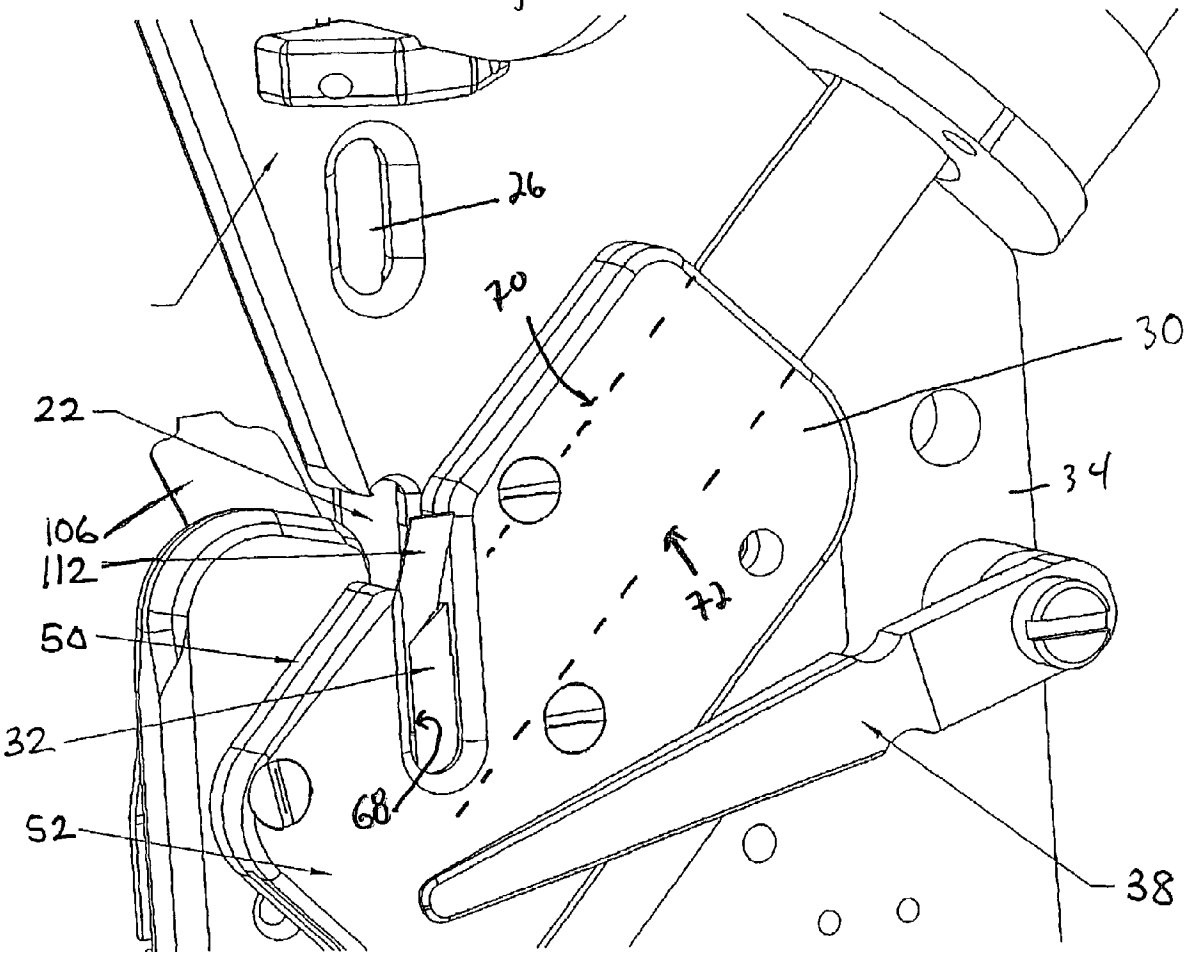
FIG. 5 is close-up perspective view of the clipper of FIG. 1, showing the knife partially through its stroke.

Because notch 60 is slightly shallower than notch 62, the bottom point 74 of notch 60 is located between top side 70 and bottom side 72 as knife 32 moves to its extended position. Accordingly, tag 106 clipped to bag will not protrude completely through aperture 64. The shallower notch 60 causes attachment arm 112 of tag 106 to stick up at an angle, as shown in FIGS. 4 and 5. Because tag 106 does not protrude through aperture 64, in most instances knife 30 will not encounter tag 106. In those instances in which the edge of knife 30 does encounter tag 106, tag 106 will be pushed upwards and out of the way, instead of being severed. In this manner, tag debris can be prevented or at least minimized.

Since tail 108 of bag 100 is pulled through notches 60, 62, such as by the operator's right hand, knife 30 will still sever tail 108 completely. The force of the operator's right hand on tail 108 will prevent knife 30 from pushing tail 108 out of the way, as knife 30 does with tag 106.

In another embodiment, knife guide 30 consists of only tag lifter plate 50. If clipper 20 is used in an automated system, for example, in which an operator's hand will not be anywhere near knife 30, knife guide plate 52 can be eliminated.

In a manually-operated clipper 20, frame 34 sits on a tabletop workstation. In an automated system, the elements of clipper 20 are separately mounted on the frame of the apparatus. Clipper 20 can be used, for example, on automated baggers, to encase material in bags, on automated netters, to enclose material in netting, or on automated sausage-making devices, to enclose material such as sausage meat in tubular films and/or tubular netting.

A representative automated bagger system that is used in conjunction with the clipper 20 of the present invention is described in U.S. Pat. No. 6,895,726, Poly-Stretch Bagger System, the disclosure of which is incorporated by reference. In such a system, automated members open a bag, a ram pushes the material, such as a whole dressed bird, into the bag 100, gathering plates close the bag to form a neck, and a clipper applies a clip to encase the material inside the bag.

A representative automated netter that is used in conjunction with clipper 20 of the present invention is described in U.S. Pat. No. 6,883,297, Apparatus for Enclosing Material in a Net, the disclosure of which is incorporated by reference. In such a system, material such as a whole dressed bird, which has been encased in a plastic bag, is enclosed in tubular netting. Irises gather the netting to form a neck and a clipper 20 applies a clip 102 and a tag 106 to enclose the material in a net.

A representative automated sausage-stuffer that is used in conjunction with clipper 20 of the present invention is described in U.S. Published Patent Application No. 2005/0087075, Apparatus and Method to Net Food Products in Shirred Tubular Casing, the disclosure of which is incorporated by reference. In such a system, material such as pasty meat product is extruded into tubular film and, optionally, into tubular netting. Irises gather the film and netting to form a neck and clipper applies a clip and a tag to seal the product within the film and netting. (Please note that tag in such a system can comprise a loop in order to hang the sausages in a smokehouse.)

While preferred embodiments of the present invention are shown and described, it is envisioned that those skilled in the art may devise various modifications of the present invention without departing from the spirit and scope of the appended claims.

We claim:

1. A clipper for applying clips and tags to bags, comprising:

a punch movable in a reciprocating path from a retracted position to an extended position;

a clip rail for feeding a clip into said reciprocating path of said punch;

a tag loading window oriented to hold a tag in said reciprocating path of said punch;

a die oriented at said extended position of said punch for receiving a clip;

a knife movable in a reciprocating path from a retracted position to cut a bag to an extended position, said knife having a cutting edge extending between a top side and a bottom side, said reciprocating path of said knife being adjacent to said die; and a tag lifter plate mounted between said die and said reciprocating path of said knife, said tag lifter plate having a top side, said tag lift plate top side being between said top side of said knife and said bottom of said knife when said knife is in said extended position.

2. The clipper of claim 1, further comprising a piston for moving said knife.

3. A system comprising the clipper of claim 1 and at least one of an automated bagger, an automated netter, and an automated sausage-stuffer.

4. A clipper for applying clips and tags to bags, comprising:

a punch movable in a reciprocating path from a retracted position to an extended position;

a clip rail for feeding a clip into said reciprocating path of said punch;

a tag loading window oriented to hold a tag in said reciprocating path of said punch;

a die oriented at said extended position of said punch for receiving a clip;

a knife movable in a reciprocating path from a retracted position to cut a bag to an extended position;

a knife guide mounted adjacent said die and comprising a first plate and a second plate, said first plate being generally parallel to said second plate and proximal to said die, said second plate being distal to said die, said plates forming a groove between said plates, said reciprocating path of said knife being within said groove;

a first notch in said first plate through which said bag extends, said first notch being parallel to and adjacent to said reciprocating path of said punch and having a first depth; and a second notch in said second plate through which said bag extends, said second notch being parallel to said reciprocating path of said punch and having a second depth, said second depth being greater than said first depth.

5. The clipper of claim 4, further comprising a piston for moving said knife.

6. A system comprising the clipper of claim 4 and at least one of an automated bagger, an automated netter, and an automated sausage-stuffer.

7. A clipper for applying clips and tags to bagged products, comprising:

means for clipping a tag to a bag;

means for severing a tail of said bag; and means for preventing protrusion of said tag into said means for severing a tail.

* * * * *

UNITED STATES PATENT AND TRADEMARK OFFICE

CERTIFICATE OF CORRECTION

PATENT NO. : 7,287,359 B1
APPLICATION NO. : 11/420028
DATED : October 30, 2007
INVENTOR(S) : Eggo Haschke and Robert Vedder It is certified that error appears in the above-identified patent and that said Letters Patent is hereby corrected as shown below:

Column 3, Line 21 “maimer.” should be -- manner. --

Column 3, Line 37 “106 mamially.” should be -- 106 manually. --

Signed and Sealed this

Sixth Day of May, 2008

JON W. DUDAS
*Director of the United States Patent and Trademark Office*